United States Patent [19]

Vilardo et al.

[11] 4,453,896

[45] Jun. 12, 1984

[54] DISTRIBUTOR PUMP WITH FLOATING PISTON SINGLE CONTROL VALVE

[75] Inventors: Louis V. Vilardo, Northville; Jack R. Phipps, St. Clair Shores, both of Mich.

[73] Assignee: The Bendix Corporation, Southfield, Mich.

[21] Appl. No.: 217,296

[22] Filed: Dec. 17, 1980

[51] Int. Cl.[3] ..... F04B 19/02

[52] U.S. Cl. ..... 417/462; 417/218

[58] Field of Search ..... 417/462; 123/450

[56] References Cited

U.S. PATENT DOCUMENTS 3,482,519 12/1969 Nicolls ..... 417/462 X 3,506,381 4/1970 Kemp ..... 123/450 X

FOREIGN PATENT DOCUMENTS 949842 2/1964 United Kingdom ..... 417/462

*Primary Examiner*—Alan Cohan

*Attorney, Agent, or Firm*—Markell Seitzman; Russel C. Wells

[57] ABSTRACT

A distributor pump type fuel injection system for a diesel engine wherein the pump is driven by the engine and the control of the timing and metering of fuel being delivered to each cylinder of the engine is controlled by a single electromagnetic solenoid device. The control system includes a distribution head for distributing pulses of fuel to each cylinder, the control of the fuel to the cylinder, both metering and timing, being controlled by the above-mentioned single electromagnetic control device. The fuel system includes a metering chamber and a timing chamber, the two chambers being separated by a free piston. In the control system to be described, fuel is premetered into the metering chamber, the quantity of fuel therein being controlled by the duration of energization of the control valve during the metering portion of the cycle. The time of injection of the premetered fuel is similarly under the control of the control valve and is initiated upon energization of the control valve.

8 Claims, 10 Drawing Figures

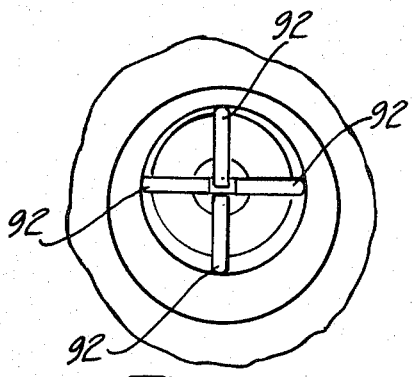
Fig-1a
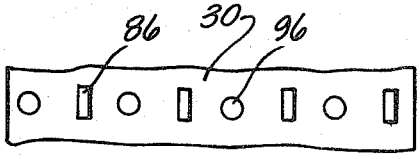
Fig-1b
Fig-7
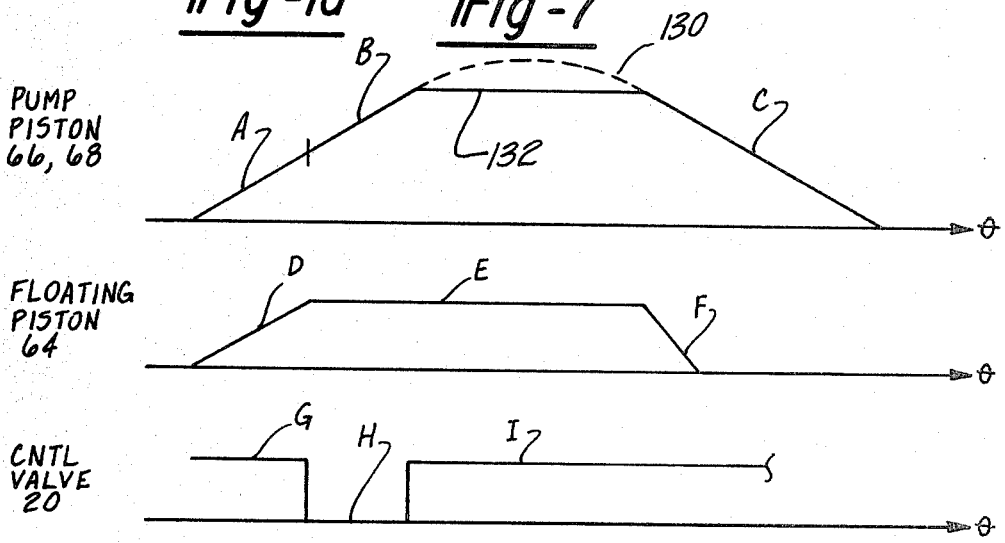
Fig-6
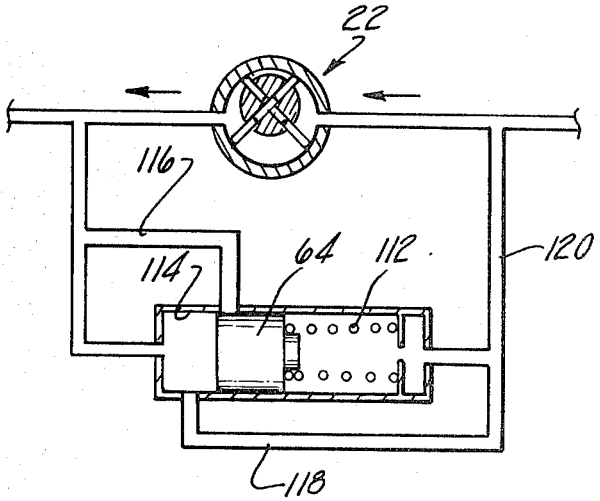

DISTRIBUTOR PUMP WITH FLOATING PISTON SINGLE CONTROL VALVE

RELATED APPLICATIONS

The instant application is related to U.S. Ser. Nos. 6,948 and 6,949, both of which were filed on Jan. 25, 1979, Ser. No. 6,949 having issued as U.S. pat. No. 4,235,374. The instant application is also related to an application filed in the name of Frank Woodruff, Ser. No. 217,299 filed Dec. 17, 1980, and an application filed in the name of Edwin Ben Watson, Ser. No. 217,298 filed Dec. 17, 1980 now U.S. Pat. No. 4,367,715. Further, this application is related to application Ser. No. 203,827, Ser. No. 203,830 and Ser. No. 203,831, all filed on Nov. 4, 1980. The above-referenced applications and patent are specifically incorporated herein by reference.

BACKGROUND OF THE INVENTION

This invention is generally related to distributor type fuel injection pumps for controlling the quantity and timing of injection of fuel into the cylinder of an engine, and in particular is related to a distributor type fuel injection pump in which the metering and timing of injection of fuel is controlled by a single electromagnetic control valve.

Distributor fuel injection pumps in which the time of injection and the period of injection are both controlled mechanically or hydraulically are well known in the art. However, recent advances in electronics have resulted in the development of electronic fuel control systems which are capable of very accurately computing fuel quantity and timing requirements in response to one or more operational parameters of the engine. These electronic control systems include electronic control units which are capable of not only computing the required fuel quantity, but also the time at which the fuel is to be injected into the cylinder to optimize the engine's performance. One such electronic control unit is disclosed in application Ser. No. 945,988. Another electronic control unit is disclosed in U.S. Pat. No. 4,219,154. Both disclosures are incorporated herein by reference. Also recently, the invention described in the above-referenced application Ser. Nos. 6,948 and 6,949 were developed, the application of the invention being initially in the field of unit injectors, however, it has been discovered that inventive concepts described in the above-referenced application could also be applied to distribution pumps to great advantage. The resulting application of that unit injector technology to distribution pumps has resulted in the invention of the present application.

SUMMARY OF THE INVENTION

The invention is a distributor type fuel injection pump in which the injection timing and fuel metering is controlled by a single electromagnetic control device, wherein the fuel for an injection into a particular cylinder is premetered prior to that injection. In a cycle of operation, the rotation of the engine causes the rotation of a shaft which is rotating at a speed which is half the speed of a four-stroke-cycle engine rotation. The rotating shaft is used to pressurize the fuel in the pump, control the communication of orifices between the source of pressurized fuel and the timing and metering chambers, and rotate a cam to control injection timing. The metering of fuel into and out of the timing and metering chambers is under the control of a single control valve.

With the system of the present invention, a single control solenoid, and a single pulse from an electronic control unit, is utilized to control the initiation of injection of fuel into a particular cylinder and also to control the amount of fuel that is to be injected into the next cylinder of the engine. The inventive concepts herein result in a very precise control of the timing and metering functions and result in a compact, relatively inexpensive pump.

BRIEF DESCRIPTION OF THE DRAWINGS

FIG. 1A is an end view of the distribution pump of FIG. 1 and particularly illustratng the vane transfer pressurizing pump of the distribution pump of FIG. 1;

FIG. 1B is an unwrapped view of the distributor sleeve at the metering inlets/delivery ports of the distribution pump of FIG. 1;

FIG. 6 is a schematic diagram illustrating a hydraulic circuit which may be utilized to prime the pump of FIG. 1 during the cranking operation of the engine;

FIG. 7 is a timing diagram illustrating a displacement curve of the pumping piston, the displacement curve of the metering piston and a diagram of the position of the control valve of the distribution pump of FIG. 1 during a typical cycle.

DETAILED DESCRIPTION OF THE DRAWINGS

Figure 1:
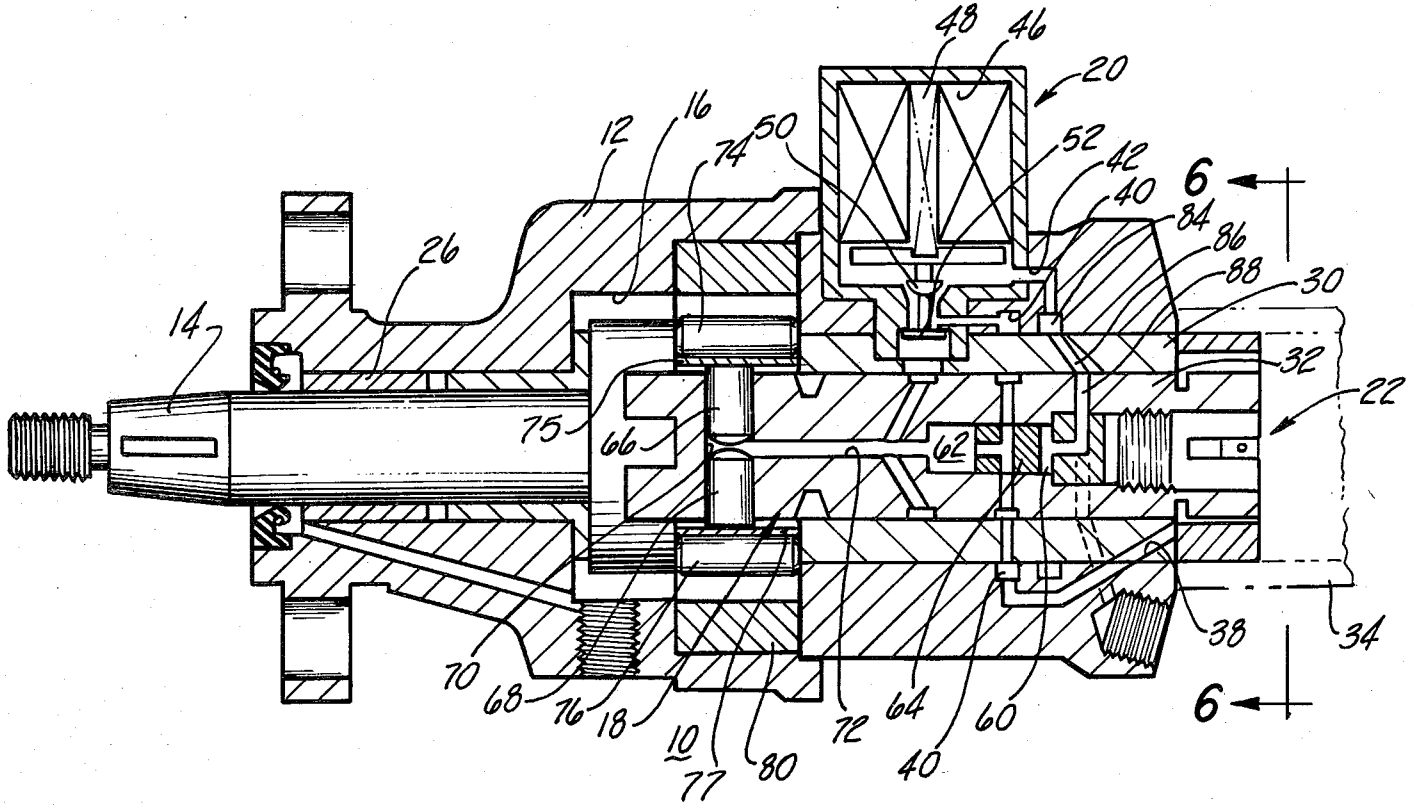
FIG. 1 is a cross-sectional view of a distribution pump for controlling the fuel being fed to an internal combustion engine, the figure particularly showing the metering portion of the fuel control cycle.

Referring now to the drawings and particularly FIG. 1 thereof, there is illustrated a distribution pump 10, the pump 10 being a modification of the distribution pump manufactured by the Stanadyne Corporation and marketed under the tradename RoosaMaster. The Stanadyne pump, as presently marketed, is a mechanically actuated and mechanically controlled pump including a governor and mechanical timing control which is particularly well suited for controlling the timing and metering of fuel to an internal combustion engine on a cylinder-by-cylinder basis. However, it is believed that a more precise control and a more simple pump has been evolved by eliminating the mechanical controls of the pump and establishing a combination hydraulic and electromagnetic circuit arrangements whereby the timing and metering of fuel to an internal combustion engine, on a cylinder-by-cylinder basis, may be controlled by a single electrical pulse generated by an electronic control unit. Typically, the electronic control unit senses desired engine operating parameters and generates control signals to control both timing and metering of fuel to the engine in accordance with the sensed parameters.

Specifically, the pump 10 includes a casing 12, which supports at one end thereof a drive shaft 14, the shaft 14 being adapted to be driven by the engine at one-half engine speed. The interior of the housing 12 is formed as a cavity 16 which houses a timing and metering assembly 18, the timing and metering assembly being controlled by means of an electromagnetic control valve 20. The timing and metering assembly 18 is rotated by the shaft 14, as is a vane transfer pump 22 which is mounted at the opposite end of the housing relative to the shaft 14. The pump 22 is utilized to pressurize the supply fuel for the operation of the timing and metering assembly 18.

Referring now to the specific details of the pump 10 shown in FIG. 1, is seen that the shaft 14 is mounted for rotation within the housing 12 and supported therein by means of a bearing 26. The shaft 14 is rigidly connected to the timing and metering assembly 18 such that the timing and metering assembly 18 is rotated by rotation of the shaft 14. The timing and metering assembly 18 is rotatably supported in a tubular sleeve 30, the sleeve 30 being press-fitted into the housing 12. The assembly 18 includes a timing and metering cylinder 32, in which are formed the various cavities and passages to perform the control functions to be described.

The vane transfer pump 22 receives fuel from a source connected to a housing member 34, the pump 22 being formed as a vane pump, see FIG. 1A, and it functions to pressurize the fuel within the housing 34. This pressurized fuel is fed to a supply passageway 38 formed in the sleeve 30 and the housing 12. The supply fuel is fed by means of passage 38 to a supply annulus 40 which is formed on the inside surface of the housing 12.

The supply fuel in annulus 40 is, in turn, in fluid communication with the interior of the control solenoid 20 by means of a passageway 41. The control solenoid 20 is adapted to be controlled by energizing the coil 46, the coil 46 controlling the position of an armature 48. The movement of the armature 48 controls a three way valve arrangement which includes a first valve 50, valve 50 controlling the flow of fuel to the metering chamber, and a second valve 52 which will be seen to control the flow of fuel to the timing chamber. The solenoid assembly 20 is mounted in an aperture through the housing and a second aperture formed in the sleeve 30. The solenoid may be mounted in any conventional fashion.

Referring now to the details of the timing and metering cylinder 32, the central portion of the cylinder 32 is formed with a metering chamber 60 and a timing chamber 62, the chambers 60 and 62 being separated by means of a free or floating piston 64. The timing chamber 62 is in fluid communication with opposing faces of a pair of pumping plungers 66, 68. The pumping plungers 66, 68 are telescopically mounted within a passageway 70 formed in the member 32. Pressurized fluid from the timing chamber 62 is fed to the opposing faces of plungers 66, 68 by means of a passageway 72. Upon pressurization of passageway 72, plungers 66, 68 are forced radially outwardly to precisely position a roller 74 associated with plunger 66 and a second roller 76 associated with plunger 68. Plungers 66, 68 act to move the rollers 74, 76 through a pair of shoes 75, 77 disposed therebetween. The rollers 74, 76 are positioned to engage a preselected position of a cam lobe formed on the interior face of a cam element 80, which cam element may be press-fitted into the housing 12. The cam surface on the interior of cam element 80 operate on rollers 74, 76 to, in turn, force plungers 66, 68 radially inwardly and thereby increase the pressure within the timing chamber 62.

As stated above, the vane transfer pump pressurizes the source of fluid within housing 34 and provides this pressurized fluid to a supply annulus 40 through a passageway 38. The view of the pump in FIG. 1, as stated above, is shown in metering portion of the control cycle. In this situation, the low pressure valve 50 is open or unseated and the high pressure valve 52 is closed or seated. Thus, the supply fluid at annulus 40 is provided to the interior of the solenoid 20 and, through passage 42, to a metering annulus 84. The pressurized fluid at metering annulus 84 is fed through a passageway 86 in sleeve 30 to a metering passageway 88. In the position of rotation illustrated, the metering passageway 88 is in fluid communication with the metering annulus 84 by means of connecting port or metering inlet slot 86. Thus, this pressurized fluid, with the solenoid 20 energized in the state shown, will cause fluid to be metered into the metering chamber 60 and force the floating piston 64 to the left. This metering will continue as long as the control valve 20 is in the energized state and the metering passageway 88 is in fluid communication with the metering inlet slot 86. As will be seen from a description of FIG. 1*b*, the metering inlet slot is positioned to provide sufficient time to meter the desired amount of fuel into the metering chamber 60.

Figure 2:
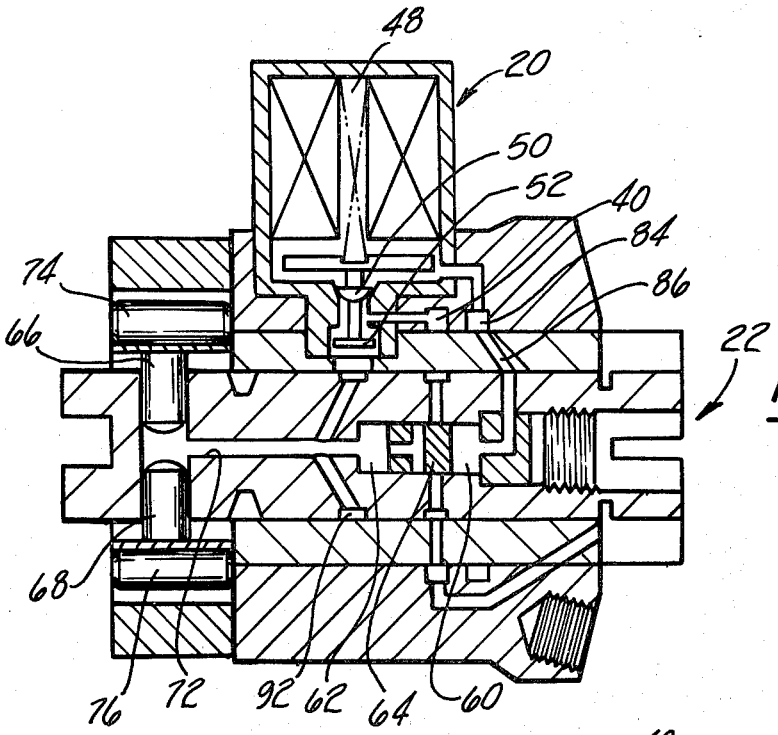
FIG. 2 is a cross-sectional view of a portion of the distribution pump of FIG. 1 and particularly illustrating the premetering of fuel into the timing chamber portion of the control cycle.

Upon the completion of metering the desired amount of fuel into the metering chamber 60, the valve 20 is deenergized as will be seen from a description of FIG. 2.

Referring now to FIG. 1*a*, it is seen that the vane transfer pump is an eccentric center pump which includes a plurality of vanes 92 which are positioned at 90 degrees one relative to the others. As seen from FIG. 1A, the chambers formed between adjacent vanes 92 will become smaller in volume as the shaft is rotated. Thus, the fluid is pressurized within the chambers.

Referring now to FIG. 1B, there is illustrated an unwrapped view of the distributor sleeve in the area of passageway 86. The metering inlet slot 86 is illustrated on the sleeve 30 through which the fuel is fed to the metering chamber. It is to be understood that the position and configuration of the inlet metering slots can be modified to accomodate the particular operation of the pump when associated with a particular engine. The circular ports 96 shown are the delivery ports which, as will be explained hereinafter, are utilized to supply fuel from the metering chamber to the engine during injection.

Referring now to FIG. 2, there is illustrated the premetering of fuel into the timing chamber 62. In the view shown in FIG. 2, it is seen that the low pressure valve 50 is closed and the high pressure valve 52 is open. Thus, the fuel supply at supply annulus 40 which is fed to the interior of the solenoid 20 is permitted to flow past the high pressure seat associated with valve 52 to a timing chamber fill annulus 92. Pressurized fuel in the fill annulus 92 is fed to the timing chamber 62 and also, by means of passageway 72, to the opposing faces of plunger 66, 68. The pressurized fuel forces the plunger 66, 68 and the associated rollers 74, 76 outwardly toward a predetermined position which is determined by the duration of de-energization of the valve in the position shown in FIG. 2. It is to be understood that the low pressure valve 50 is closed and therefore fuel from the metering chamber cannot be forced out of the metering chamber in response to the pressure being built on the timing side of the floating piston 64.

Figure 3:
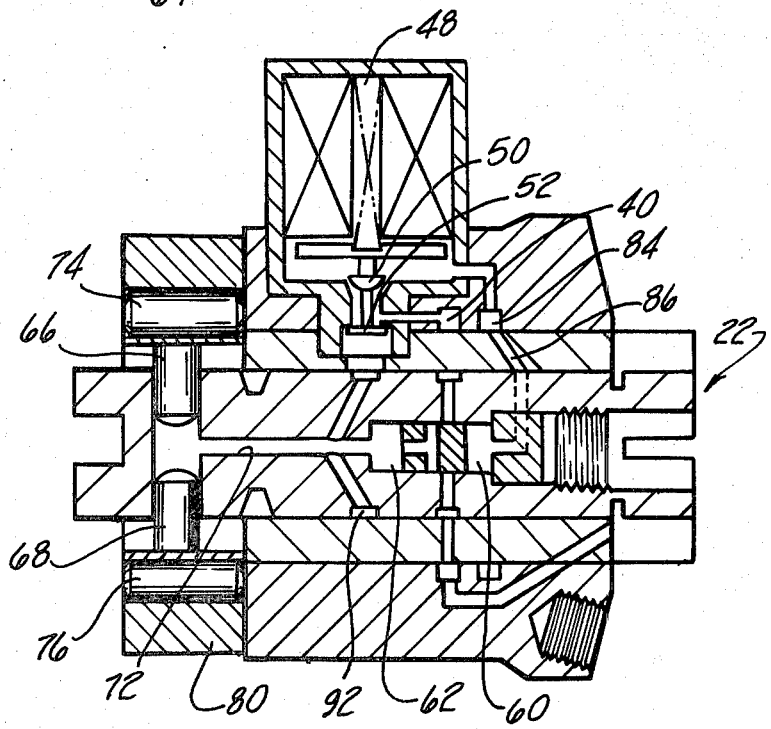
FIG. 3 is a cross-sectional view of the distribution pump of FIG. 1 and particularly illustrating the final position of the pumping plungers and rollers prior to the start of the injection cycle.

Referring now to FIG. 3, it is seen that the low pressure valve is now open and the high presure valve 52 is closed. The closure of the valve 52 terminates the flow of fluid into the timing chamber 62 thereby terminating the radially outward motion of the pistons 66, 68. This operation precisely positions piston 66, 68, and thus rollers 74, 76 associated therewith, in a position which will determine at which point on the cam face of cam member 80 is engaged by the rollers 74, 76. In the particular assembly illustrated, the shape of the back side of the cam face is precisely controlled to allow for continuous engagement between the rollers 74, 76 and the cam face during the time that the timing chamber is being pressurized. Thus FIG. 3 illustrates the precise position of rollers 74, 76 relative to the cam element 80 and shows the initial point for the system prior to injection.

Figure 4:
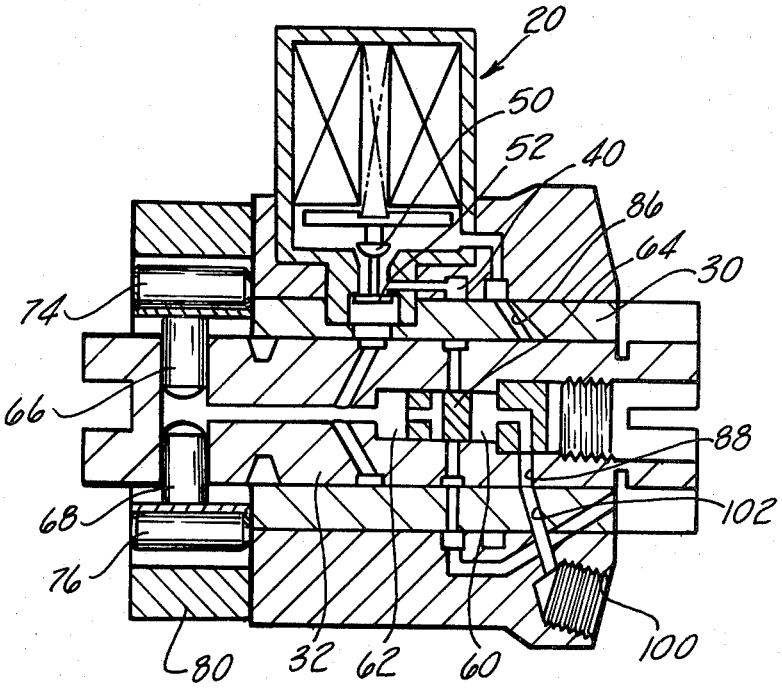
FIG. 4 is a cross-sectional view of the distribution pump of FIG. 1 and particularly illustrating the injection portion of the fuel control cycle.

Referring now to FIG. 4, there is illustrated the injection portion of the fuel control cycle wherein the high pressure valve 52 is shown in the closed position. Thus, the timing chamber is hydraulically closed to preclude fluid from flowing from the timing chamber to the supply annulus 40 through the high pressure seat associated with valve 52. At the start of injection, the cam 80 forces plunger 66, 68 radially inwardly through rollers 74, 76. This pressurizes the fluid in timing chamber 62 and forces the floating piston 64 to the right. This movement of the floating piston 64 pressurizes the metering chamber 60 thereby forcing the fuel out of metering chamber 60 to a discharge connection at threaded portion 100 by means of passageway 88 and a delivery port passage 102 formed in the sleeve 30. The communication between passage 88 and passage 102 is created by rotation of the core member 32. The fact that low pressure valve 50 is open is of no consequence as the communication between metering chamber 60 and metering inlet slot 86 is terminated due to this same rotation.

Figure 5:
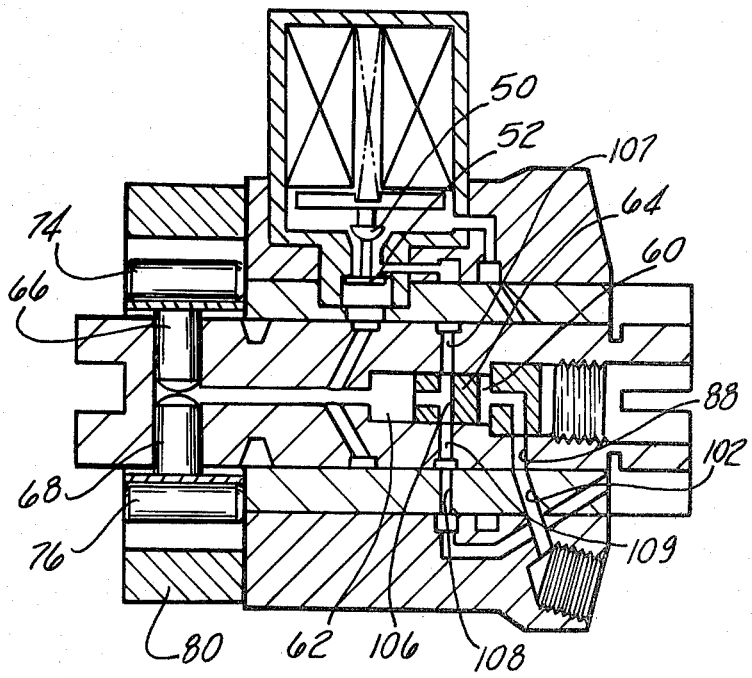
FIG. 5 is a cross-sectional view of the distribution pump of FIG. 1 and particularly illustrating the end of injection or dumping portion of the fuel control cycle.

Referring now to FIG. 5, there is illustrated the final or end of injection portion of the control cycle. In this portion of the cycle the pressurized fuel is dumped back to the supply. In the illustration of FIG. 5, it is seen that the high pressure valve 52 is closed and the low pressure valve 50 is open. When the floating piston 64 travels sufficiently to cause passage 106 to align with dump ports 107, 109 in core member 32, the pressure in timing chamber 62 is vented back to supply via passageway 108. Once passage 106 is aligned with ports 107, 109, further displacement of plungers 66, 68 simply dump additional fuel back to the supply circuit. As the pressure in the timing chamber drops, the floating piston 64 stops displacing fluid out of the metering chamber 60, and the injection event is terminated. Thus the assembly has returned to the position shown in FIG. 1 and is now ready for the next fuel control cycle.

Referring now to FIG. 6, there is illustrated a schematic diagram of the hydraulic circuit associated with the transfer pump and the floating piston. Normally in systems of the type described in the present invention, there would be provided a spring 112 which is utilized to bias the floating piston 64 to the left as shown in the diagram of FIG. 6. Accordingly, when the engine is shut down and the pump 22 is not pressurizing the system, the piston 64 will position itself to the left in the chamber 114. During initial cranking of the engine, there is insufficient pressure to move the piston 64 to the right to create a normal operation situation. Accordingly, a bypass passageway 116 is provided from the outlet of the pump 22 to the interior of cavity 114. When the piston is in the extreme left position, the passageway 116 is open to the interior of the cavity and the passage 118 is covered by piston 64. The system normally includes a fuel pump (not shown) which feeds the inlet of transfer pump 22. The pressure from this fuel pump is fed to a line 120 through the interior of cavity 114 and through passage 116 to the outlet side of the transfer pump 22. In this way, the normal fuel pump will purge and charge the lines connected to the outlet of pump 22. After sufficient cranking has occurred to build up the pressure at the outlet side of pump 22, the piston will be forced to the right to cover the passage 116 and uncover passage 118. The piston will then react in a normal modulating manner.

Referring now to FIG. 7, there is illustrated a composite graph illustrating the pump piston position, the floating piston position and the control valve energization state relative to engine crank angle. In the upper diagram of FIG. 7, the pump pistons 66, 68 positions relative to the cam profile are illustrated. The cam profile is shown as the dotted line 130 while the position of the pump pistons 66, 68 are shown as solid line 132. It is seen that the position of the piston departs from the cam profile, the departure varying depending on the degree to which the pistons are forced radially outwardly by the pressurization of the timing chamber. During time A shown in FIG. 7, the metering chamber is being premetered with fuel in accordance with the operation described in conjunction with FIGS. 1–5. During portion B of curve 132, the timing chamber is being premetered with fuel to position pistons 66, 68 and the piston follow the position shown. Upon termination of premetering the timing chamber, the pump piston position curve 132 departs from the dotted cam profile 130 to remain at the preselected position. When the cam again meets the pumping piston position at curve 132, the pumping pistons then following the position of the cam profile. This occurs at injection.

The middle curve is the position of the floating piston and it is seen that during metering, portion A of curve 132, which corresponds to portion D of the middle curve, the piston is moved to a preselected position depending on how much fuel is metered into the metering chamber. During the metering of fuel into the timing chamber, portion B of curve 132, the floating piston assumes the position shown at E and remains there during the time of portion B of curve 132 and also the time that curve 132 departs from curve 130. This is shown as position E in the middle graph. Upon injection, the piston is returned to its original position and follows the portion F of the middle curve.

As will be seen from a review of the operation of FIGS. 1–5, the control valve is energized, shown by level G of the lower curve, during the premetering of the metering chamber. Upon the time the system premeters the timing chamber, the control valve is de-energized. When the curve at 132 departs from curve 130, the holding portion of the curve, the solenoid is again energized as shown by the rise to the level I at the lower end of FIG. 7.

If the speed range of the system described in conjunction with FIGS. 1–7 is desired to be increased to encompass higher speeds, there may be insufficient time to meter fuel when the aperture 86 is in registry with the passageway 88. Accordingly, a modification to the pump of FIG. 1 has been provided and is shown as FIG. 8. In the case of FIG. 1, metering can only take place when passageway 86 and passageway 88 are in registry whereas in the modification of FIG. 8, metering can begin as soon as the previous injection portion of the control cycle has been completed.

Figure 8:
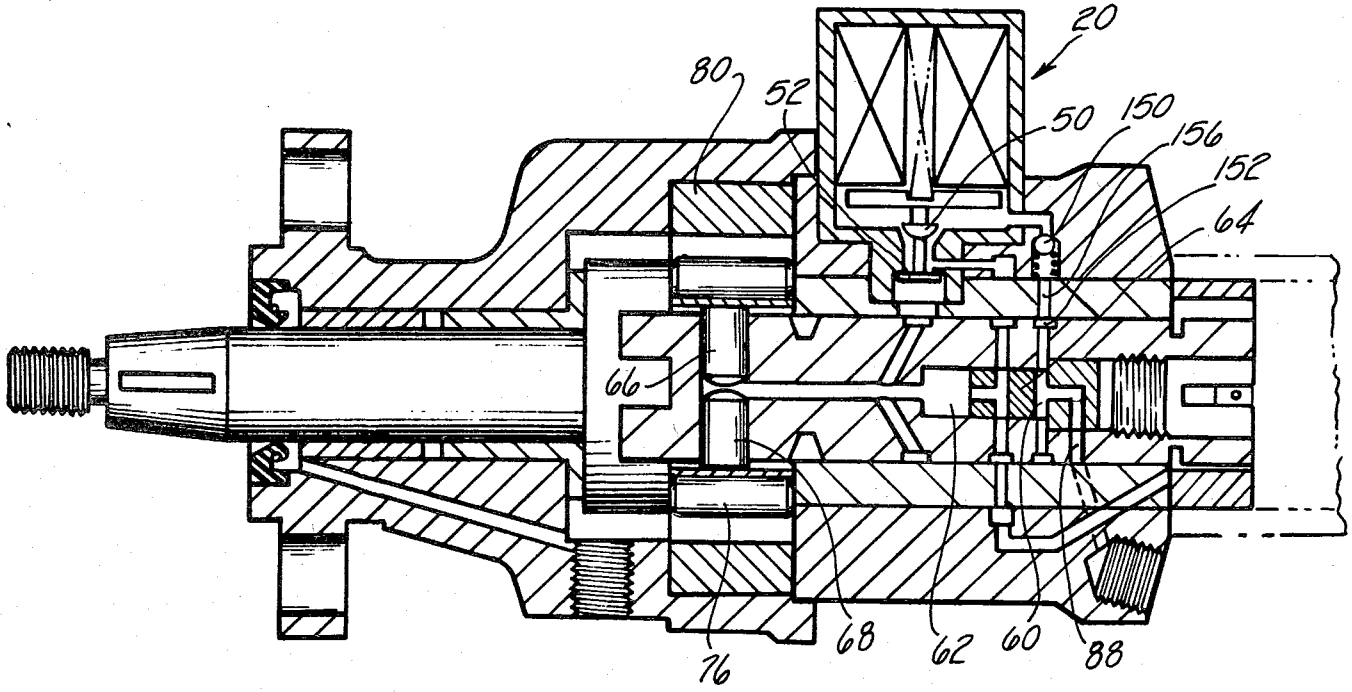
FIG. 8 is a modified form, illustrated in cross section, of the distribution pump of FIG. 1 and particularly illustrating a pump which may be utilized for high speed operation.

Referring now to the details of FIG. 8, it is to be noted that the configuration of FIG. 8 is substantially identical to the configuration illustrated in FIGS. 1–5 with exceptions to be noted below. The major change involves the addition of a check valve 150 in the output passageway from the control valve 20, the addition of a metering annulus 152 and a provision of a passageway 156 which is in fluid communication between the cavity supporting the valve 150 and the metering annulus 152. Thus, during the metering portion of the cycle, low pressure valve 50 is open and high pressure valve 52 is closed as was the case with FIG. 1. However, the passage 156 is devised such that as soon as the injection portion of the previous cycle is completed, the passage 156 is in fluid communication with the cavity supporting check valve 150 and the metering annulus 152. In this way, metering of fuel into the metering chamber 60 may start in response to the operation of the control valve 20 without waiting for the metering inlet slot to be in fluid communication with the passage 88.

It is to be noted that the operation of FIG. 8 involves real time metering of the timing chamber and there is no control of the ultimate position of piston 66, 68. The pistons 66, 68 are forced, through pressurization of timing chamber 62, to the extreme position wherein they are always in contact with the cam face of cam member 80.

The invention has been described in an illustrative manner, and is to be understood that the terminology which has been used is intended to be in the nature of words of description rather than of limitation. Many modifications and variations of the present invention are possible in light of the above teachings. It is, therefore, to be understood that the invention may be practiced otherwise than as specifically described.

What is claimed is:

1. A distributor pump for controlling the injection of fuel into individual cylinders of an internal combustion engine comprising a housing, an input shaft supported for rotation in said housing, a pressurized source of fuel, a timing and metering assembly having a body and a cavity formed therein, a floating piston in said cavity forming a timing chamber and a metering chamber in said cavity on either side of said floating piston, said body having a metering passage formed therein for communicating said metering chamber with the exterior surface of said body, said assembly being rotated by said shaft, a sleeve fixedly supported in said housing having a first set of metering and discharge ports formed therein, one metering port and one discharge port for each cylinder, said metering passage being rotated, in succession, from a metering port to a discharge port, an electromagnetically responsive control valve having two states, one state controlling the metering of fuel into said timing chamber and the other controlling the premetering of fuel into the metering chamber, cam means supported in said housing, and means supported in said assembly in engagement with said cam means for forcing fuel into said timing chamber and initiating injection.

2. The pump of claim 1 wherein said pressurized source of fuel includes a pump supported in said housing and driven by said shaft.

3. The pump of claim 2 wherein said fuel forcing means includes radially acting pistons in engagement with said cam, the movement of said pistons initiating injection.

4. The pump of claim 1 wherein said control valve is a three way valve having first and second valve seats and valves, said first valve and seat controlling flow of fuel to said timing chamber and said second valve and seat controlling flow of fuel to said metering chamber.

5. The pump of claim 1 wherein said timing chamber is controlled on a real time basis.

6. The pump of claim 4 wherein said first valve and seat are closed at a determinable instant during the compression stroke of said pistons to permit a certain amount of fuel previously resident in said timing chamber to exit therefrom.

7. A distributor pump for controlling injection of fuel into individual cylinders of an internal combustion engine comprising:

a housing;

an input or drive shaft supported for rotation within said housing;

a pressurized source of fuel;

said housing defining a first annulus in communication with said source of fuel, a first passage communicating with said first annulus, a second and a third passage terminating at a metering annulus;

an electromagnetic valve supported within said housing having two operational states wherein said first state controls fuel flow between said first and second passages, and wherein said second state controls fuel flow between said first and third passages;

said housing further defining a bore having a first set of metering and discharge ports formed therein, one metering and discharge port for each cylinder;

a timing and metering assembly fixed for rotation in said bore and rotatable with said drive shaft, having a body and a cavity formed therein, a floating piston forming a timing chamber and a metering chamber in said cavity on either side of said floating piston, said body having a metering passage formed therein for communicating said metering chamber with the exterior surface of said body, said metering passage being rotated, in succession, from a metering port to a discharge port; and cam means supported in said housing, and means supported in said assembly in engagement with said cam means for forcing fuel into said timing chamber and initiating injection.

8. A distributor pump for controlling injection of fuel into individual cylinders of an internal combustion engine comprising:

a housing;

an input or drive shaft supported for rotation within said housing;

a pressurized source of fuel;

said housing defining a first annulus in communication with said source of fuel, a first passage communicating with said first annulus, a second and a third passage terminating at a metering annulus;

an electromagnetic valve supported within said housing having two operational states wherein said first state controls fuel flow between said first and second passages, and wherein said second state controls fuel flow between said first and third passages;

said housing further defining a bore having a first set of discharge ports formed therein, one metering and discharge port for each cylinder;

a timing and metering assembly fixed for rotation in said bore and rotatable with said drive shaft, having a body and a cavity formed therein, a floating piston forming a timing chamber and a metering chamber in said cavity on either side of said floating piston, said body having a metering passage formed therein for communicating said metering chamber with a second annulus formed on the exterior surface of said body in communication with said third passage, said metering passage being rotated, in succession, to each one of said discharge port; and cam means supported in said housing, and means supported in said assembly in engagement with said cam means for forcing fuel into said timing chamber and initiating injection.

* * * * *